US007661635B2

(12) United States Patent
McConnell

(10) Patent No.: US 7,661,635 B2
(45) Date of Patent: Feb. 16, 2010

(54) BAG HOLDER FOR A T-SHIRT BAG

(75) Inventor: Peter McConnell, Encinitas, CA (US)

(73) Assignee: Cool Stuff, LLC, Encinitas, CA (US)

( * ) Notice: Subject to any disclaimer, the term of this patent is extended or adjusted under 35 U.S.C. 154(b) by 0 days.

(21) Appl. No.: 11/715,717

(22) Filed: Mar. 8, 2007

(65) Prior Publication Data

US 2007/0210217 A1 Sep. 13, 2007

Related U.S. Application Data

(63) Continuation-in-part of application No. 11/526,284, filed on Sep. 25, 2006, now Pat. No. 7,404,531.

(60) Provisional application No. 60/779,833, filed on Mar. 8, 2006.

(51) Int. Cl.
*B65B 67/12* (2006.01)

(52) U.S. Cl. ..... 248/95; 248/99; 141/316

(58) Field of Classification Search ..... None
See application file for complete search history.

(56) References Cited

U.S. PATENT DOCUMENTS 121,529 A * 12/1871 William ..... 141/84
435,474 A * 9/1890 Young ..... 248/100
477,235 A * 6/1892 Timmerman ..... 248/99
490,578 A * 1/1893 Merry ..... 248/99
544,585 A * 8/1895 Mayo ..... 141/341
576,782 A * 2/1897 Goodrich ..... 141/390

(Continued)

OTHER PUBLICATIONS

Search Report and Written Opinion for PCT/US2007/05972 (related to the present application), published Nov. 3, 2008, Cool Stuff, LLC.

(Continued)

*Primary Examiner*—Kimberly T Wood
(74) *Attorney, Agent, or Firm*—Roeder & Broder LLP

(57) ABSTRACT

A bag holder (650) for holding a t-shirt bag (651) includes a holder frame (652) and a holder handle (654) that is secured to the holder frame (652). The holder frame (652) selectively holds the t-shirt bag (651) and including a first handle restraint (658) that restrains a first bag handle (651B) of the t-shirt bag (651), and a second handle restraint (660) that restrains a second bag handle (651D) of the t-shirt bag (651). The holder handle (654) is movable relative to the holder frame (652) between a carrying position (678) in which the holder handle (654) is used for carrying the holder frame (652) and the t-shirt bag (651), and an attachment position (680) in which that holder handle (654) is used for hanging the holder frame (652) and the t-shirt bag (651) near a vertical surface (676). With this design, the bag holder (650) can easily be carried and moved by hand, and the bag holder (650) can be easily secured to a door (686). Further, the holder frame (652) can include a frame base region (664) that is adapted to engage a horizontal surface (672) to hold the bag support region (656) and the bag opening (651A) above the horizontal surface (672). With this design, the bag holder (650) can easily be placed on the horizontal surface (672) such as a countertop, or the bag holder (650) can be hung on the door (686).

20 Claims, 11 Drawing Sheets

U.S. PATENT DOCUMENTS 657,284 A * 9/1900 Eddy ..... 248/100
973,414 A * 10/1910 Eastham ..... 248/100
1,008,101 A * 11/1911 Adams ..... 119/68
1,045,281 A * 11/1912 Gunderson ..... 248/101
1,240,852 A * 9/1917 Israelson ..... 248/100
1,266,522 A * 5/1918 Oldham ..... 141/108
1,713,095 A * 5/1929 Scheffler ..... 248/101
2,289,695 A * 7/1942 Bryant ..... 248/150
2,305,863 A * 12/1942 Ginter ..... 248/100
3,017,653 A * 1/1962 Bird ..... 15/257.8
3,796,402 A * 3/1974 Trotta ..... 248/97
4,050,492 A 9/1977 Veilleux
4,069,993 A * 1/1978 Shanks ..... 248/97
4,238,868 A 12/1980 Sternberg
4,445,658 A * 5/1984 Ferron ..... 248/99
D286,217 S * 10/1986 Waun et al. ..... D34/6
4,832,291 A 5/1989 Nelson et al.
4,877,207 A * 10/1989 Farah ..... 248/97
4,892,277 A * 1/1990 Tobis ..... 248/101
4,919,546 A 4/1990 Imazeki et al.
4,957,252 A * 9/1990 Watkins ..... 248/97
4,971,274 A 11/1990 Mitchell
5,014,943 A 5/1991 Nelson et al.
5,020,751 A 6/1991 Larkin
5,031,948 A 7/1991 Groth et al.
5,154,378 A 10/1992 Plum
5,163,645 A 11/1992 Caruso
D345,838 S * 4/1994 Bunn ..... D34/6
5,350,142 A * 9/1994 Kurtzman et al. ..... 248/99
5,400,989 A * 3/1995 Gaskill ..... 248/97
5,445,398 A * 8/1995 Pierce ..... 280/47.26
5,493,751 A * 2/1996 Misiukowiec et al. .... 15/257.06
5,513,823 A * 5/1996 Bresnahan ..... 248/99
5,522,729 A * 6/1996 Maddox ..... 434/236
5,711,563 A * 1/1998 Sapp ..... 294/1.1
5,718,400 A * 2/1998 Dwy ..... 248/99
D391,722 S * 3/1998 Sheppard ..... D34/5
5,799,908 A * 9/1998 Downs ..... 248/97
5,799,993 A * 9/1998 Lafferty ..... 294/1.4
5,875,902 A * 3/1999 Emery et al. ..... 211/90.03
5,947,602 A * 9/1999 Coxsey ..... 383/33
5,997,061 A * 12/1999 Langley ..... 294/1.1
6,039,370 A * 3/2000 Dooley et al. ..... 294/1.5
6,142,350 A * 11/2000 Alexander ..... 224/407
6,152,408 A * 11/2000 O'Grady ..... 248/100
6,155,521 A * 12/2000 O'Hanlon ..... 248/99
6,209,596 B1 * 4/2001 Wong ..... 141/391
6,375,131 B1 4/2002 Youst
6,488,241 B1 * 12/2002 Kyte et al. ..... 248/95
6,488,243 B2 * 12/2002 Kim ..... 248/100
6,517,033 B2 * 2/2003 Russell et al. ..... 248/99
6,517,034 B1 * 2/2003 Kinchen ..... 248/99
6,726,156 B1 * 4/2004 Scola ..... 248/95
6,932,126 B1 * 8/2005 Spagnolo ..... 141/316
7,007,991 B1 * 3/2006 Sapp ..... 294/1.1
D519,701 S * 4/2006 Trudeau ..... D34/6

OTHER PUBLICATIONS

International Preliminary Report on Patentability (Chapter I of the Patent Cooperation Treaty) for PCT/US2007/05972 (related to the present application), published Dec. 11, 2008, Cool Stuff, LLC.

* cited by examiner

BAG HOLDER FOR A T-SHIRT BAG

RELATED APPLICATIONS

This application claims priority on U.S. Provisional Application No. 60/779,833 filed on Mar. 8, 2006. This application is also a continuation in part of U.S. application Ser. No. 11/526,284, filed on Sep. 25, 2006 now U.S. Pat. No. 7,404,531 and entitled "Trash Bag Holder With Handle". The contents of U.S. Provisional Application No. 60/779,833 and U.S. application Ser. No. 11/526,284, are incorporated herein by reference.

BACKGROUND

Plastic t-shirt type bags are commonly used in many stores, such as department, grocery, and hardware stores to package the goods that were purchased by the customer at the store. After use, the t-shirt bags are often thrown away or sometimes recycled. Unfortunately, there is currently not a convenient way to reuse these t-shirt type bags.

SUMMARY

The present invention is directed a bag holder for holding a t-shirt bag. A typical t-shirt bag includes a bag opening, a first bag handle and a second bag handle. The bag holder includes a holder frame and a holder handle that is secured to the holder frame. The holder frame selectively holds the t-shirt bag and including a first handle restraint that restrains the first bag handle, and a second handle restraint that restrains the second bag handle. In one embodiment, the holder handle is movable relative to the holder frame between a carrying position in which the holder handle is used for carrying the bag frame and the t-shirt bag, and an attachment position in which that holder handle is used for hanging the holder frame and the t-shirt bag near a vertical surface. With this design, in certain embodiments, the bag holder facilitates the reuse of t-shirt bags, the bag holder can easily be carried and moved by hand, and the bag holder can be easily secured to a door.

In one embodiment, the holder handle is substantially horizontally oriented in the carrying position and the holder handle is substantially vertically oriented in the attachment position. Further, the holder handle can pivot relative to the holder frame about a handle axis of pivot. Moreover, the holder handle include a handle hook that engages a top of a door to attach the holder frame to the door.

Additionally, the holder frame can include a bag support region that supports the t-shirt type bag near the bag opening. In this embodiment, the bag support region and the handle restraints cooperate to maintain the bag opening open.

In another embodiment, the bag holder is designed for alternatively retaining a t-shirt bag near a vertical surface or holding at least a portion of the t-shirt bag above a horizontal surface. In this embodiment, the holder frame includes a bag support region that supports the t-shirt type bag, a first handle restraint that restrains the first bag handle, a second handle restraint that restrains the second bag handle, and a frame base region that is adapted to engage the horizontal surface to hold the bag support region and the bag opening above the horizontal surface. Further, in this embodiment, the holder handle can be used for securing the holder frame near the vertical surface. With this design, in certain embodiments, the bag holder facilitates the reuse of t-shirt bags, the bag holder can easily be placed on a horizontal surface such as a countertop or hung on a door.

BRIEF DESCRIPTION OF THE DRAWINGS

The novel features of this invention, as well as the invention itself, both as to its structure and its operation, will be best understood from the accompanying drawings, taken in conjunction with the accompanying description, in which similar reference characters refer to similar parts, and in which.

DESCRIPTION

Figure 1:
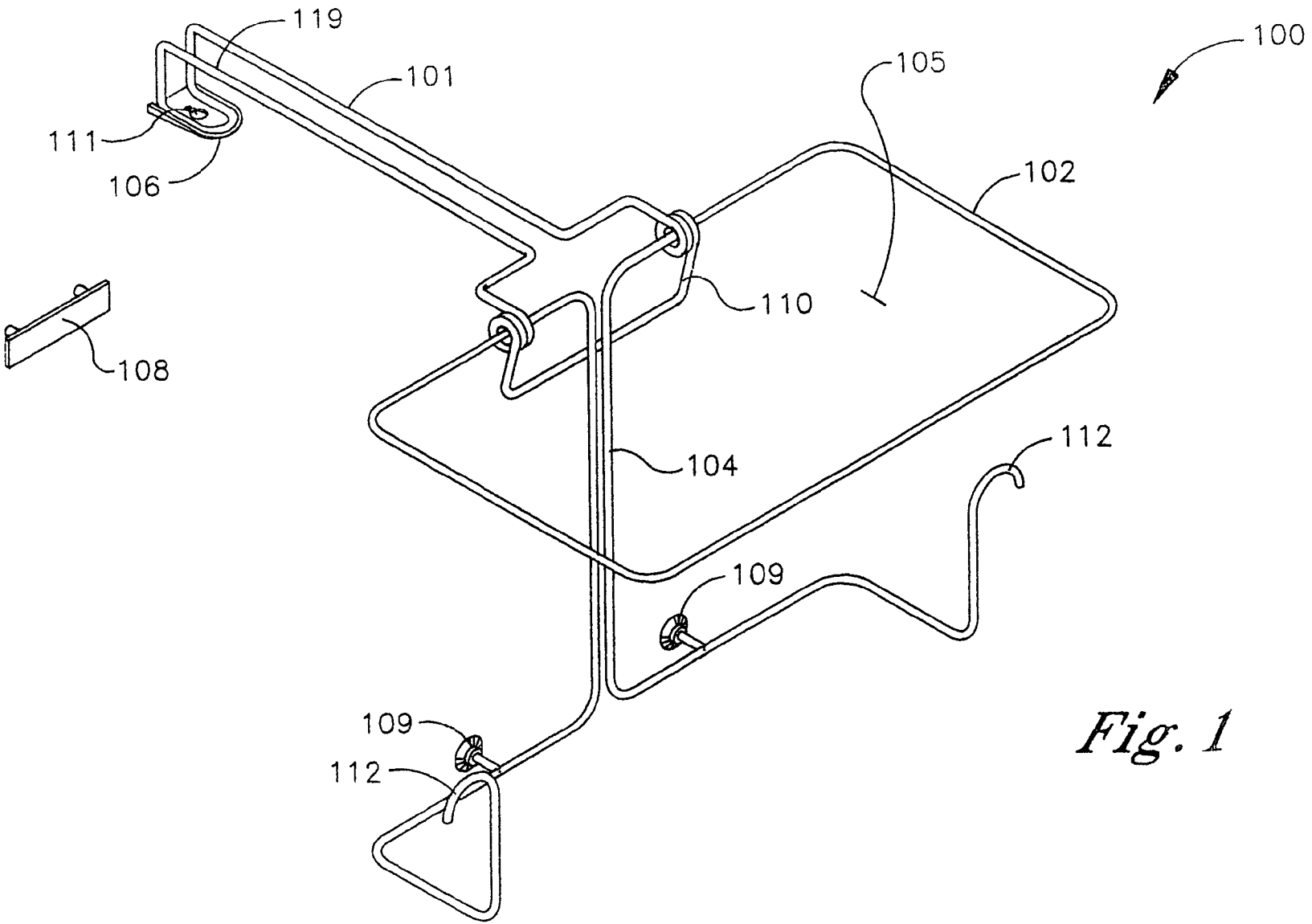
FIG. 1 is a perspective view of one embodiment of a bag holder having features of the present invention.

FIG. 1 illustrates a first embodiment of a bag holder 100 for retaining a t-shirt type bag (not shown). In this embodiment, the bag holder 100 includes a bag handle 101 and a holder frame 102. In one embodiment, the bag holder 100 is made of a wire frame construction that confers light weight and rigidity. The handle 101 is connected to the holder frame 102 such that a handle restraint bar 110 of the bag handle 101 can connect with a backbone 104 of the holder frame 102 to permit the bag holder 100 to be held by hand while a top opening 105 of the holder frame 102 is horizontal.

In certain embodiments, there are three modes in which the bag holder 100 hangs from a fixed support. In a first vertical mode, the bag handle 101 is allowed to hang vertically, a handle attachment device 106 of the bag handle 101 is inserted into an attachment slot formed between a vertical surface (not shown in FIG. 1) and an attachment beam 108 that is attached to the vertical surface. In this mode, one or more bag holder frame bumpers 109 of the holder frame 102 rest against the vertical surface to maintain the orientation of the holder frame 102.

In a second vertical mode, the bag handle can define a handle attachment opening 111, is placed over a protruding object such as a screw or a nail (not shown) attached to the vertical surface. The weight of the holder frame 102, the attached t-shirt bag, and the contents of the t-shirt bag is borne by the screw and the bag handle 101.

In a third vertical mode, a distal end of the bag handle 101 is generally "U" shaped and defines a hook space 119 that can be used to hook over a horizontal straight edge (not shown in FIG. 1) such as a cupboard door top or a closet door. In this mode, the weight of the bag frame 102 and the t-shirt bag is borne by the distal end of the bag handle 101.

In certain embodiments, the bag holder 100 includes two handle restraints 112 that hold the handles of a standard t-shirt bag. The t-shirt bag is attached to the bag holder 100 by pulling the t-shirt bag up through the top opening 105 by means of the t-shirt bag handles and then folding each handle of the t-shirt bag over the rim of the top opening 105 such that the t-shirt bag handle loop is hooked around each handle restraint 112.

The t-shirt bag is then held firmly by the bag holder 100 and can be filled with trash when the bag handle 101 is in a carrying position where it can be is carried by hand, or in one of the vertical modes, positioned adjacent to a vertical surface.

Figure 2:
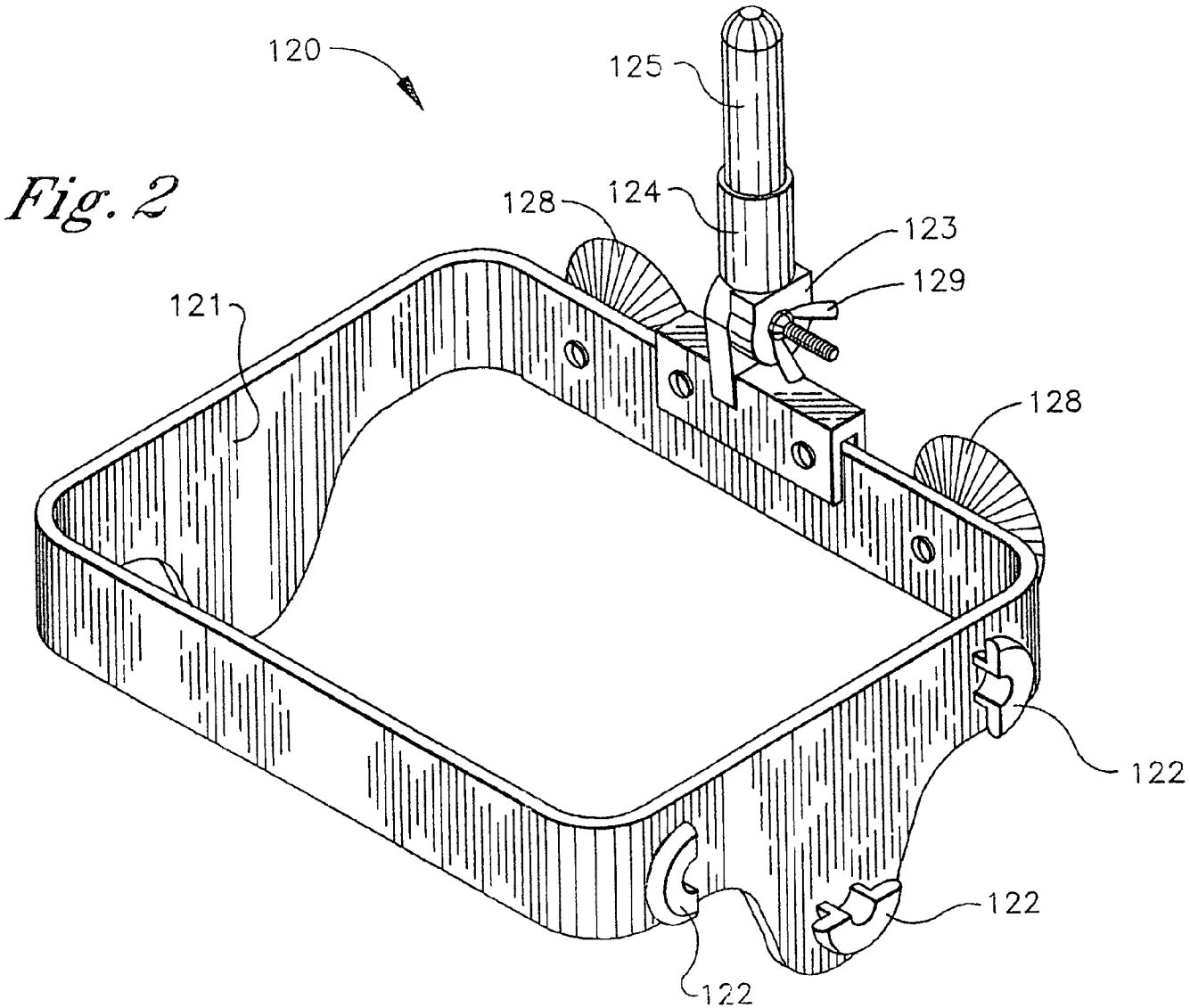
FIG. 2 is a perspective view of another embodiment of a bag holder having features of the present invention.

An alternative embodiment of the bag holder 120 is illustrated in FIGS. 2-5. In this embodiment, the rectangular frame 121 is made of plastic, with the bag attachment points 122 cast separately and attached fixedly with glue or other means. The handle connection mechanism 123 is shown in FIG. 2 to be screwed on but in this embodiment is glued after separate casting. The handle rotation control mechanism 125 is ratcheted with attached butterfly nut 129, permitting the handle 126 to be moved between the carrying and the attachment position.

Figure 3:
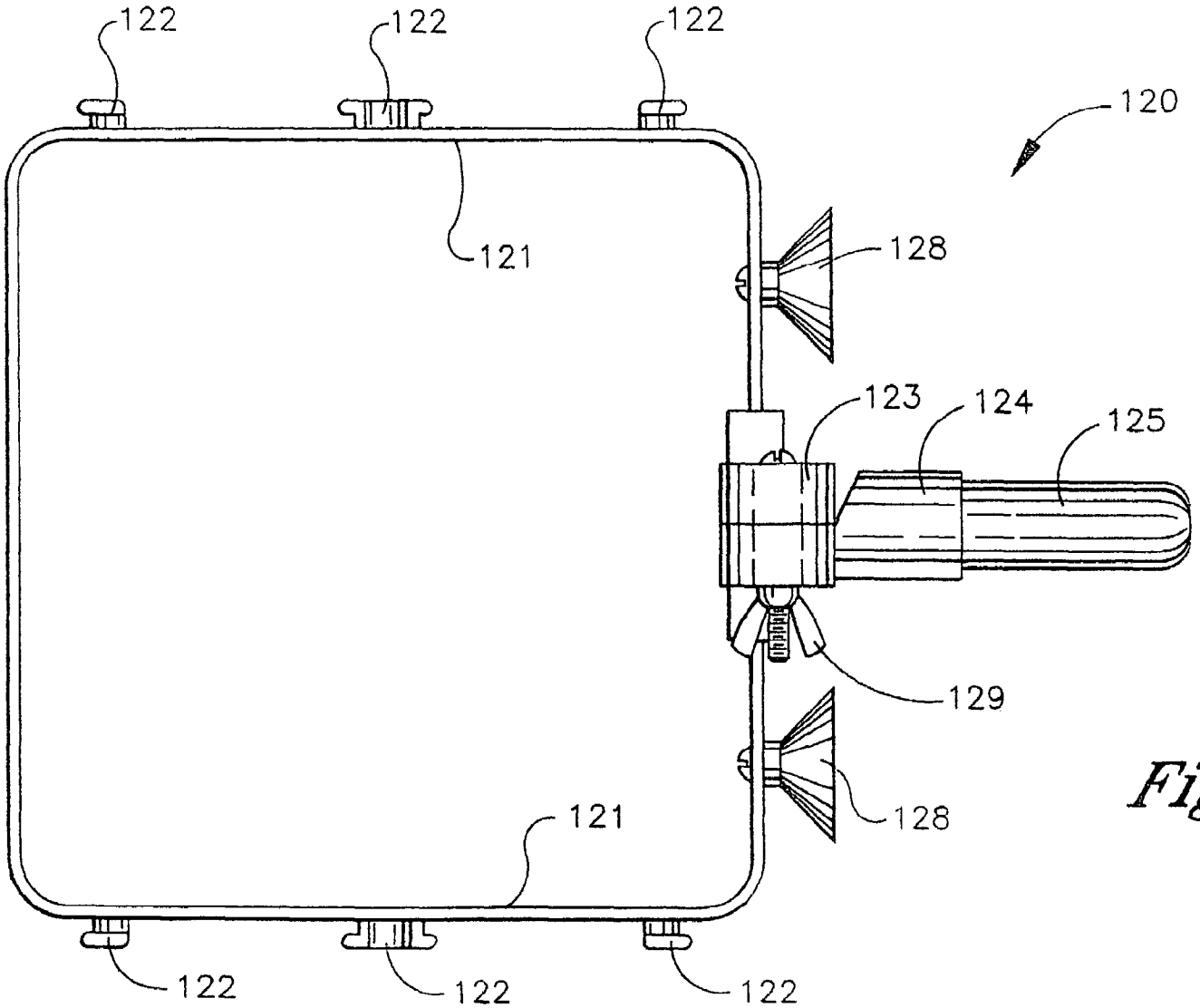
FIG. 3 is a top view of the bag holder of FIG. 3.

FIG. 3 illustrates the top view of the bag holder 120, with the profile of the bag attachment points 122. These bag attachment points 122 are designed to allow a standard thickness shopping bag handle to be wound around them to secure the bag.

Figure 5:
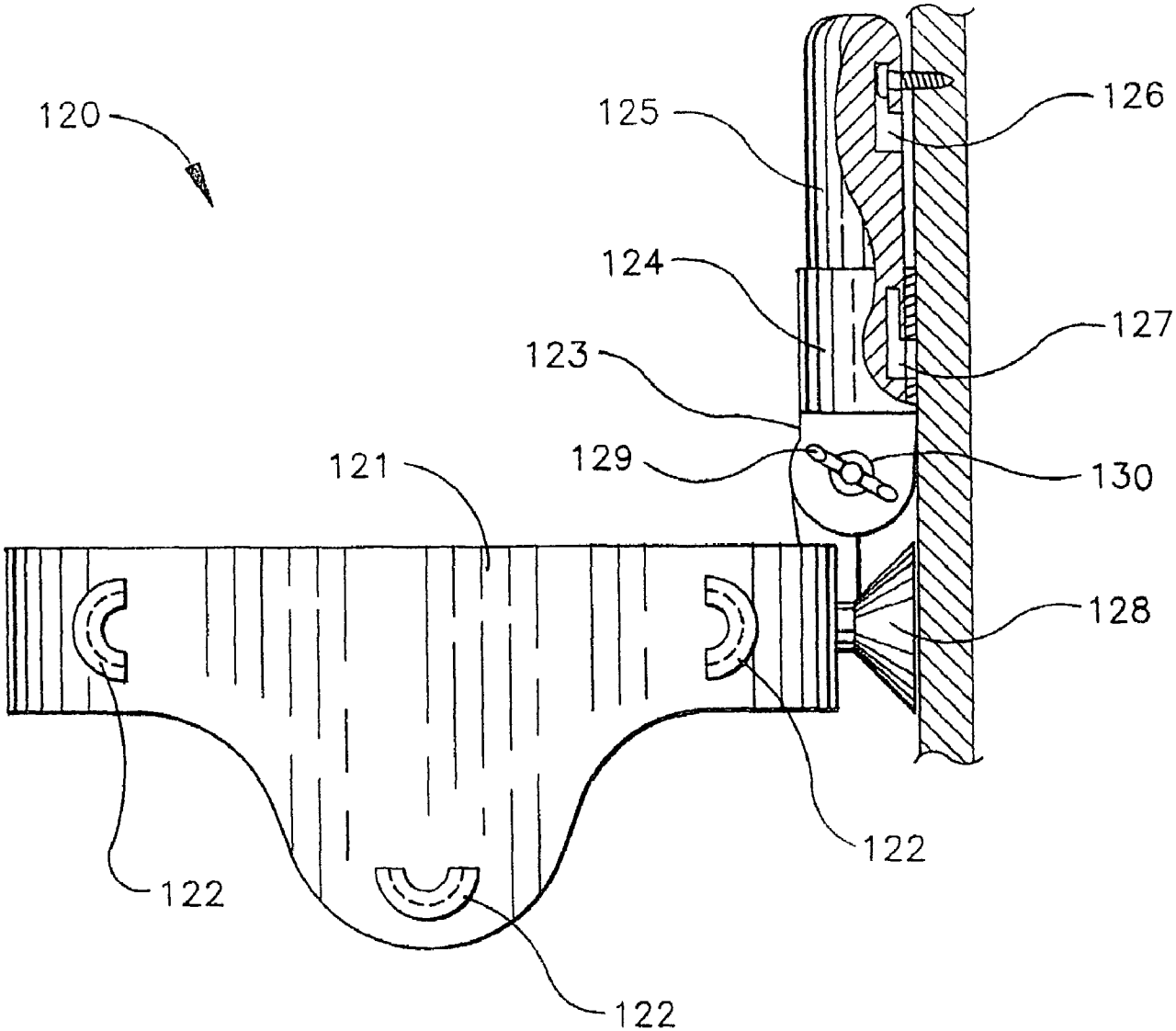
FIG. 5 is a side view of the bag holder of FIG. 2 with the holder handle in an attachment position.

The handle 123 as shown is optionally in two pieces: a handle receiver 124 made of plastic and a handle part 125 made optionally of wood but can be also made of plastic. The handle part 125 optionally screws into the handle receiver 124. The handle part 125 possesses two handle attachment points 126, 127 as shown in FIG. 5 in cutaway view. In an alternative embodiment, the handle receiver 124 and handle part 125 are cast together into a single handle with the two handle attachment points 126, 127 cast into it.

The upper handle attachment point 126 is used for the standard short shopping bags and the lower one for longer plastic bags. The handle 123 is in the "up" position in FIG. 5 and the circular bumpers 128 in the handle side of the frame allow the invention 120 to stand away form the surface of the wall or door the invention 120 is suspended from. The circular bumpers 128 confer increased stability and inhibit the frame 121 from rotating around the suspension point at the handle attachment point 126, 127.

Figure 4:
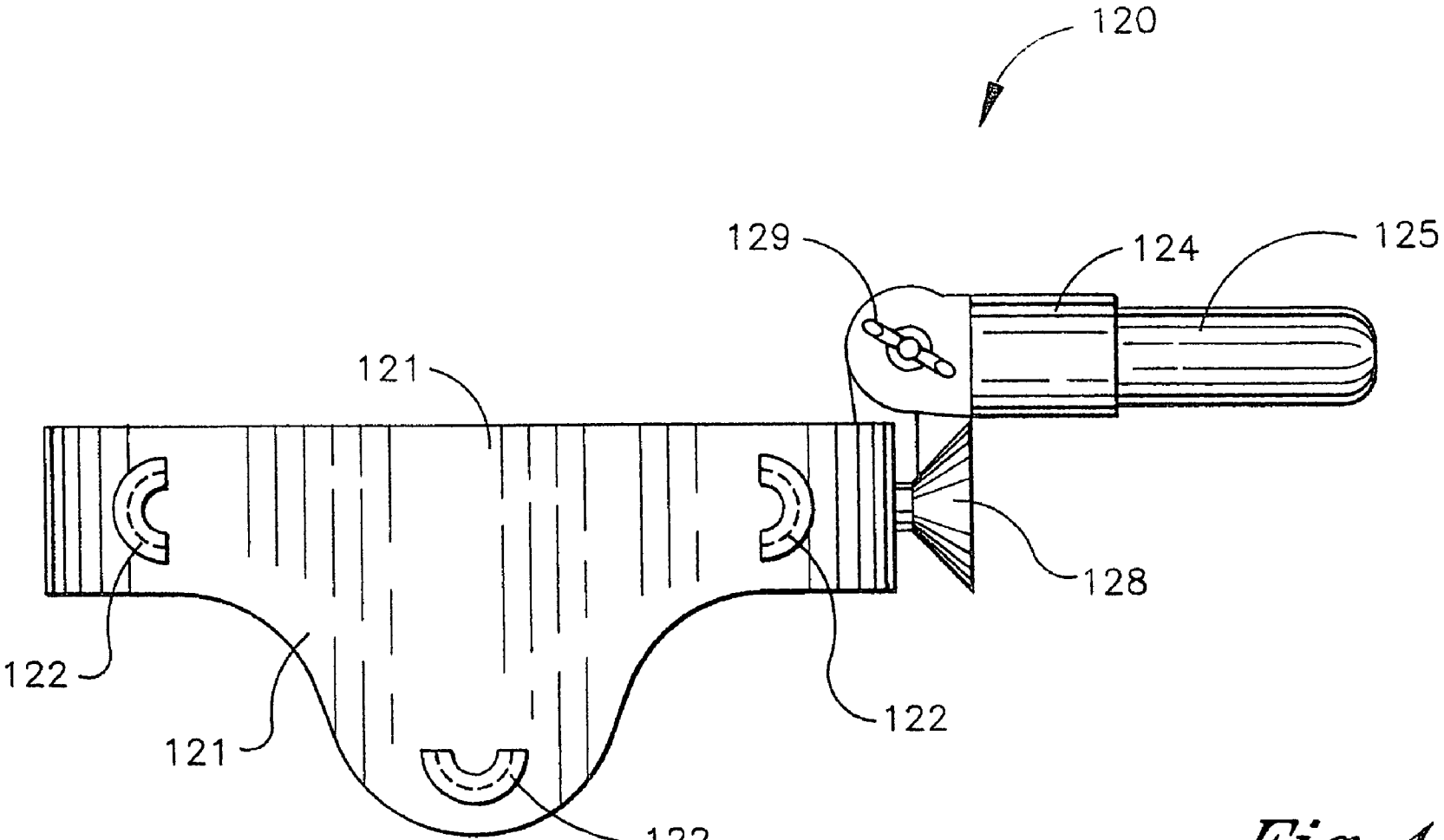
FIG. 4 is a side view of the bag holder of FIG. 2 with a holder handle in a carrying position.

FIG. 4 illustrates the invention 120 with the handle 123 in the carrying position, where it can be used to carry the frame 121 and attached bag for easy use in collecting litter. The handle rotation control mechanism 130 is strong enough so that when the butterfly nut 129 is tightened down, the ratchet will not rotate while the bag is attached to it and being carried away.

Figure 6A:
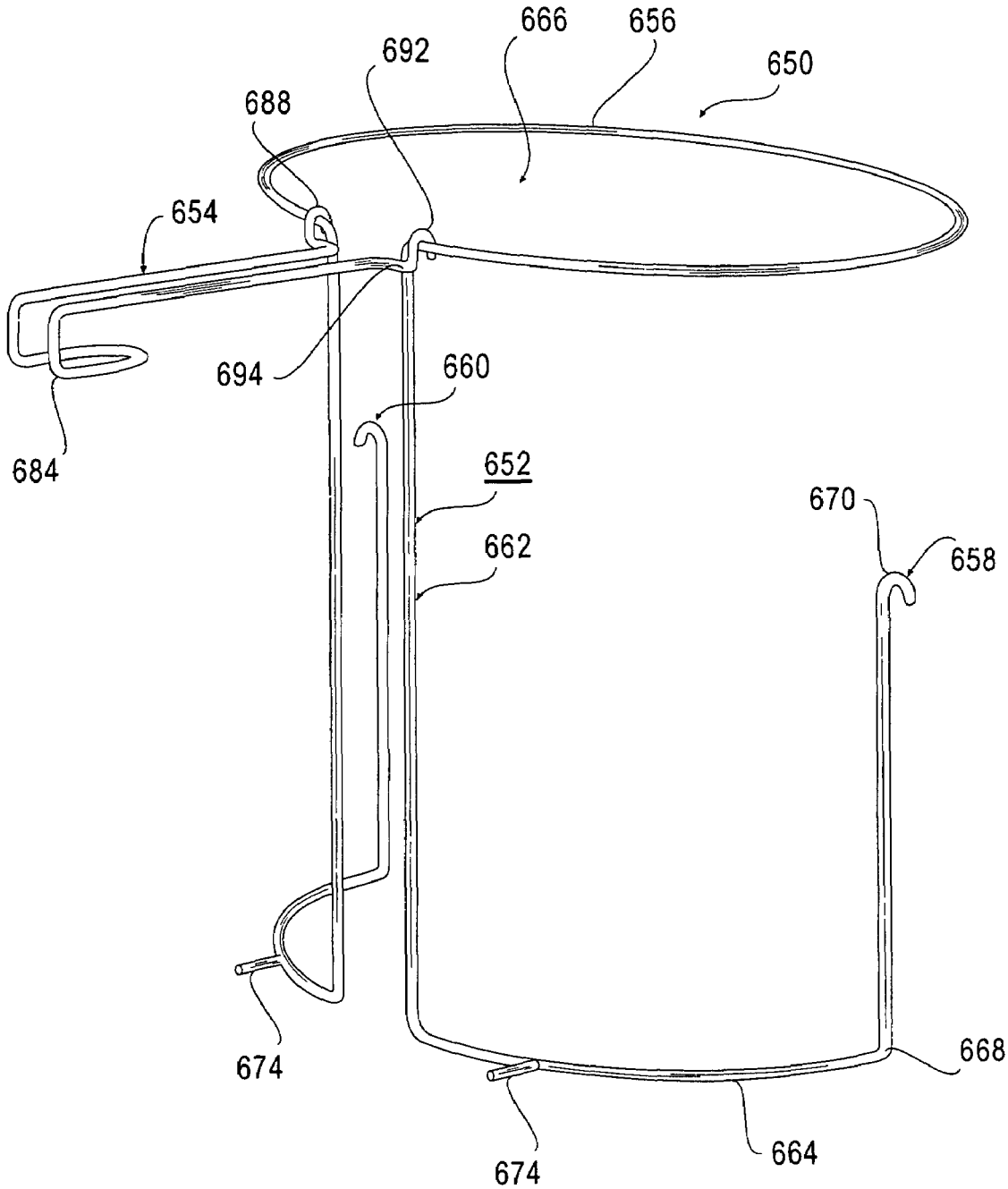
FIGS. 6A and 6B are alternative perspective views.
Figure 6B:
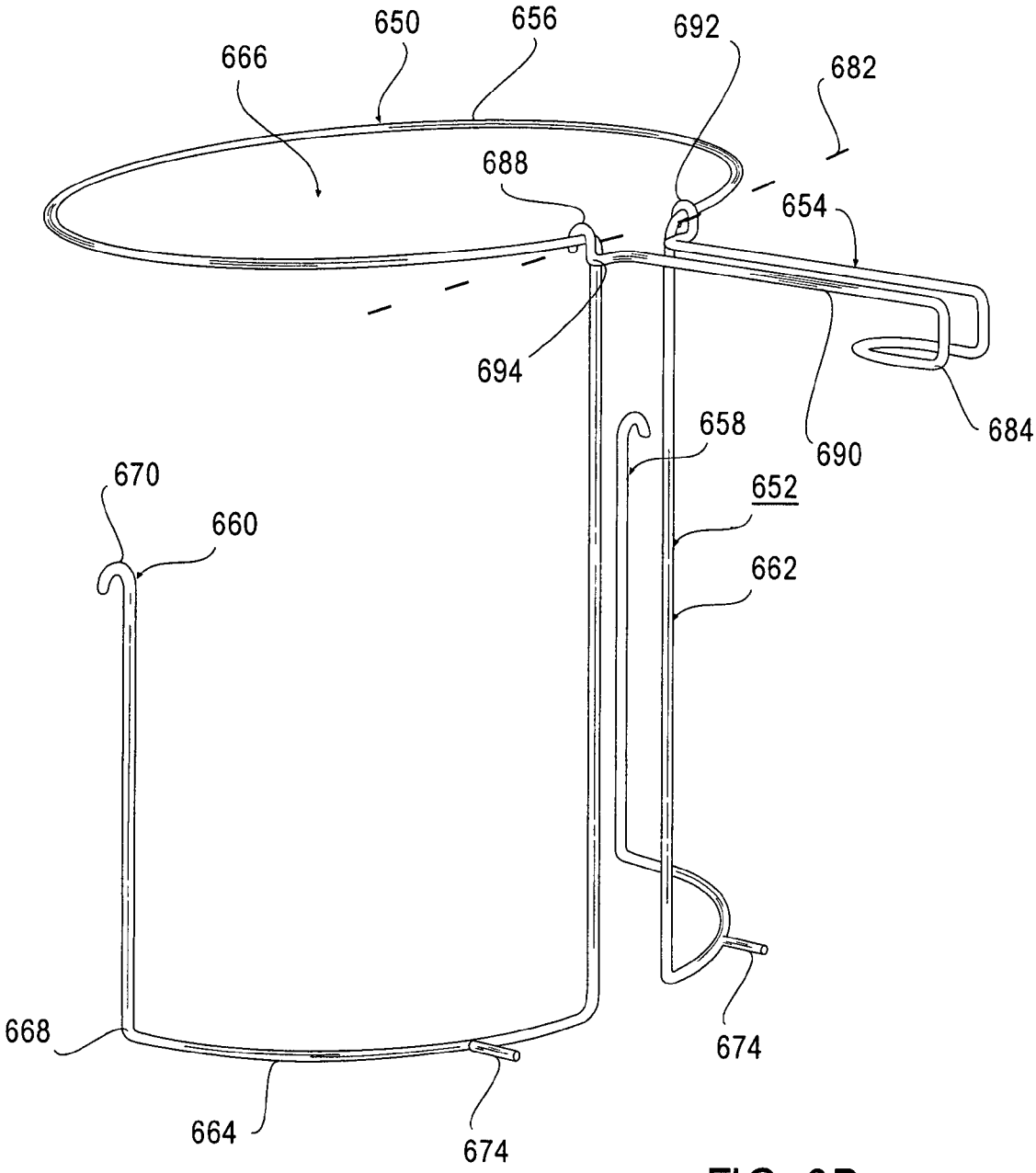
Figure 6C:
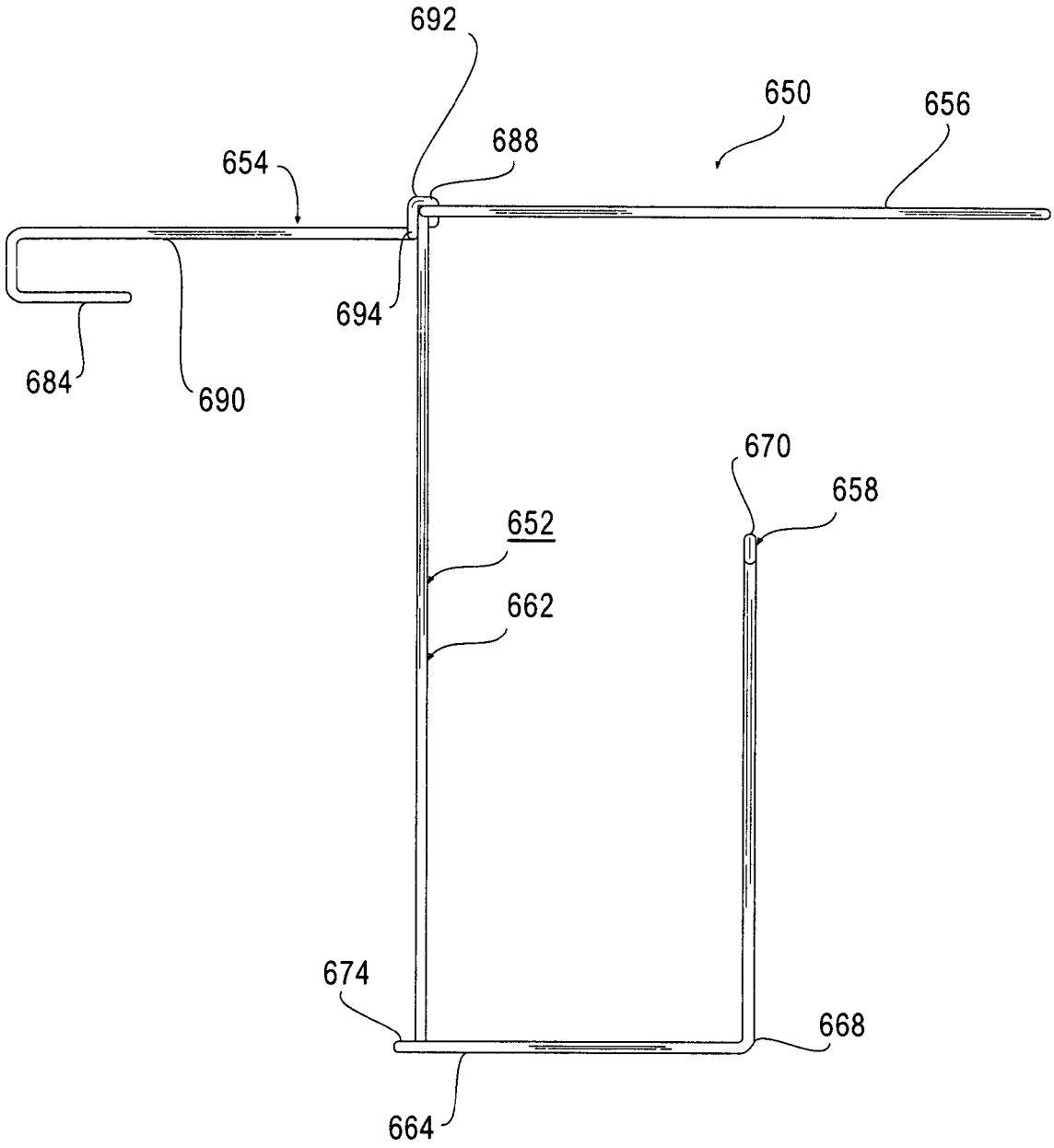
FIG. 6C is a side view of yet another embodiment of a bag holder having features of the present invention with a bag handle in the carrying position.
Figure 6D:
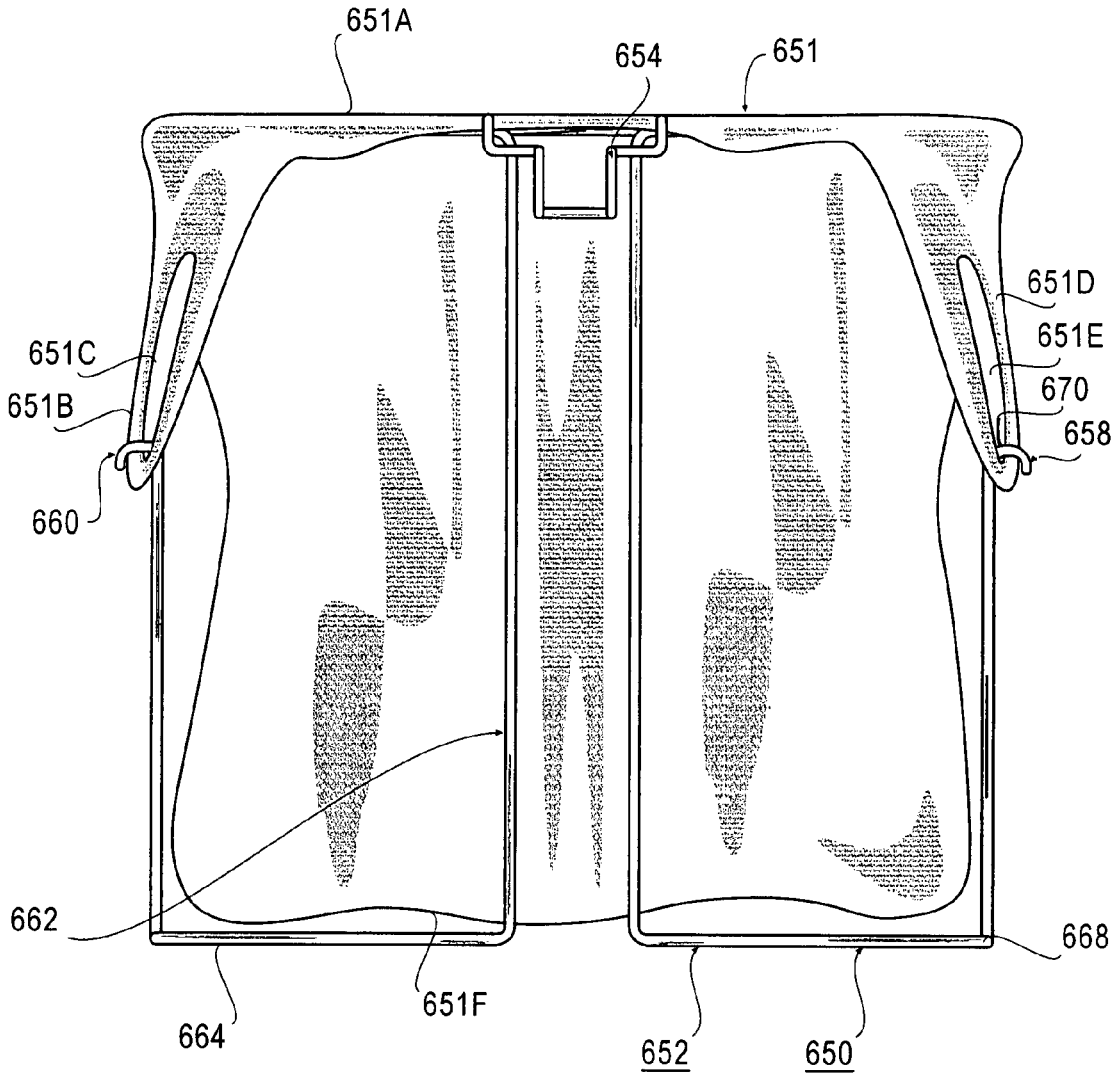
FIG. 6D is a top view of the bag holder of FIGS. 6A-6C with a T-shirt type bag retained by the bag holder.

FIGS. 6A and 6B are alternative perspective views, and FIG. 6C is a side view of yet another embodiment of a bag holder 650 that is somewhat similar to the bag holders described above and illustrated in FIGS. 1-5. FIGS. 6D illustrates this embodiment of the bag holder 650 with a t-shirt type bag 651 retained by the bag holder 650. In this embodiment, as illustrated in FIG. 6D, the t-shirt bag 651 includes a bag opening 651A, a first bag handle 651B that defines a first handle opening 651C, a second bag handle 651D that defines a second handle opening 651E, and a bag bottom 651F. Further, in this embodiment, the bag handles 651B, 651D are spaced apart and positioned on opposite sides of the bag opening 651A.

As used herein, the term "t-shirt bag" shall include any bag commonly referred to as a t-shirt bag, any shopping/grocery bag with handles, any plastic bag with handles, or any carrying bag with handles.

In one embodiment, the bag holder 650 includes a holder frame 652 and a holder handle 654. The size, shape, design, and materials used in each of these components can vary pursuant to the teachings provided herein. In this embodiment, the holder frame 652 includes a bag support region 656, a first handle restraint 658, a second handle restraint 660, a backbone region 662, and a frame base region 664.

The bag support region 656 supports the t-shirt type bag 651 with the bag opening 651A held open. For example, the bag support region 656 can support the t-shirt bag 651 near the bag opening 651A. In one embodiment, the bag support region 656 is somewhat annular ring shaped and forms a frame opening 666 for receiving a portion of the t-shirt bag 651.

The first handle restraint 658 restrains the first bag handle 651B, and the second handle restraint 660 retains the second bag handle 651D. In one embodiment, the handle restrains 658, 660 are positioned on oppose sides of the frame opening 666. Further, the handle restrains 658, 660 can be positioned between the bag support region 656 and the frame base region 664. In the embodiment illustrated in FIGS. 6A-6D, each of the handle restraints 658, 660 is shaped somewhat like a cane and includes a proximal end 668 that is secured to and extends upward from the frame base region 664 and a distal end 670 that is generally inverted "U" shaped. Alternatively, handle restraints 658, 660 can have a different design than that illustrated in FIGS. 6A-6D.

The backbone region 662 extends between the bag support region 656 and the frame base region 664 and maintains the bag support region 656 spaced apart from the frame base region 664. In the embodiment illustrated in FIGS. 6A-6D, the backbone region 662 includes a pair of spaced apart rod shaped beams. Alternatively, backbone region 662 can have a different design than that illustrated in FIGS. 6A-6D. For example, the backbone region 662 can include one or more cross members (not shown) that extend between the beams to provide additional support for the beams.

The frame base region 664 is designed to engage a horizontal surface 672 (illustrated in FIG. 6F) to hold the rest of the holder frame 652 and the bag opening 651A of the t-shirt bag 651 above the horizontal surface 672. In the embodiment illustrated in FIGS. 6A-6D, the frame base region 664 includes a pair of spaced apart arch shaped segments. Alternatively, the frame base region 664 can have a different design than that illustrated in FIGS. 6A-6F. In certain embodiments, as illustrated in FIG. 6D, the bag holder 650 maintains the bag bottom 651F above the frame base region 664.

Figure 6E:
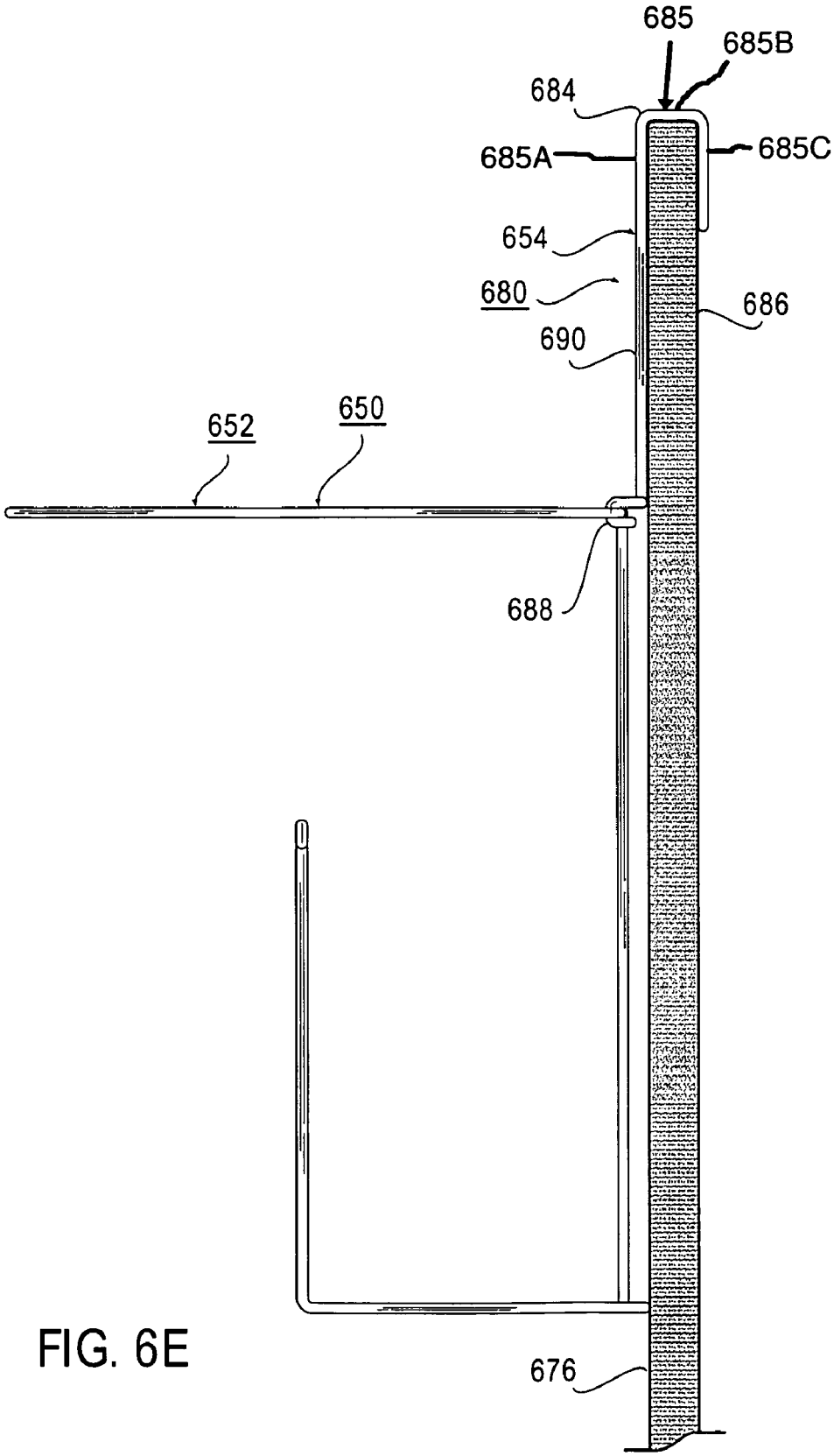
FIG. 6E is a side view of the bag holder of FIGS. 6A-6C with a holder handle in the attachment position securing the bag holder near a vertical surface.

Additionally, the holder frame 652 can include one or more frame bumpers 674 that maintain a portion of the holder frame 652 away from a vertical surface 676 (illustrated in FIG. 6E). In FIGS. 6A-6C, the holder frame 652 includes two rod shaped stand-offs 674 that extend away from the frame base region 664.

In one non-exclusive embodiment, the holder frame 652 can be made of one continuous, five gauge wire that is bent to form the bag frame 652. Alternatively, for example, the holder frame 652 can be made with (i) a wire that is a different gauge than five, (ii) a discontinuous wire, (iii) a tube, or (iv) another type of structure. Non-exclusive examples of suitable materials for the bag frame 652 include aluminum or steel.

Figure 6F:
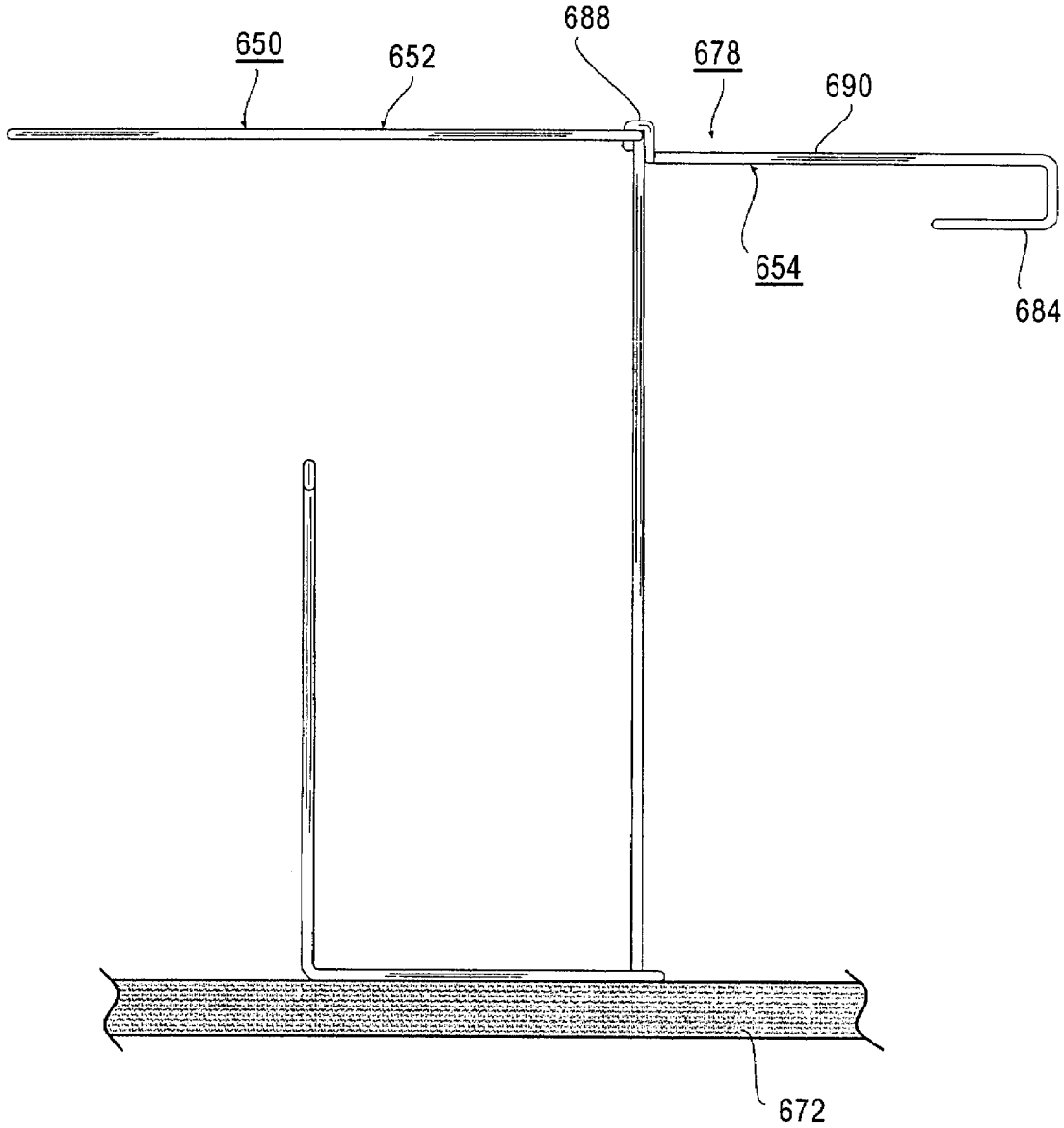
FIG. 6F is a side view of the bag holder of FIGS. 6A-6C with the holder handle on a vertical surface and the holder handle in the carrying position.

Referring additionally to FIGS. 6E and 6F, the holder handle 654 is secured to the holder frame 652 and movable relative to the holder frame 652 between a carrying position 678 (illustrated in FIGS. 6F) in which the holder handle 654 can be used for carrying the holder frame 652 and the t-shirt bag 651, and an attachment position 680 (illustrated in FIGS. 6E) in which that holder handle 654 is used for retaining the holder frame 652 and the t-shirt bag 651 near the vertical surface 676. In one embodiment, the holder handle 654 is substantially horizontally oriented (substantially parallel to the bag support region 656) in the carrying position 678 and the holder handle 654 is substantially vertically oriented (substantially perpendicular to the bag support region 656) in the attachment position 680. Additionally, in one embodiment, the holder handle 654 can pivot relative to the holder frame 652 about a handle axis of pivot 682 (illustrated in FIG. 6B) during movement between the positions 678, 680.

In one embodiment, the holder handle 654 includes a distal end 684 that defines a handle hook region 685 that engages a top of a door 686 (illustrated in FIG. 6E), a proximal end 688 that is pivotable secured to the holder frame 652, and a body region 690 that secures the distal end 684 to the proximal end 688. As illustrated in FIG. 6E, the handle hook region 685 is generally U shaped, and includes (i) a first side 685A of the U shaped handle hook region 685 that is connected to the body region 690, (ii) a bottom 685B of the U shaped handle hook region 685 that extends over the door 686, and (iii) a second side 685C of the U shaped handle hook region 685 that is spaced apart from the first side 685A. In this embodiment, the bottom 685B and the second side 685C cantilever away from the body region 690 and engage the door to selectively attach the holder frame 652 to the door 686. In this embodiment, the proximal end 688 includes a pair of spaced apart looped regions 692 that each encircle a portion of the bag support region 656 and a pair of spaced apart engagement regions 694 that selectively engage the backbone region 662. In this embodiment, the looped regions 692 allow the holder handle 654 to pivot relative to the holder frame 652 while the engagement regions 694 engage the backbone region 662 when the holder handle 654 is in the carrying position 678 to inhibit further rotation of the holder handle 654 so that the holder handle 654 can be used to carry the bag holder 650. Further, in this embodiment, the body region 690 includes a pair of spaced apart beams. Alternatively, the holder handle 654 can have a configuration that is somewhat different than that illustrated in Figures.

In one non-exclusive embodiment, the holder handle 654 can be made of one continuous, ten gauge wire that is bent to form the holder handle 654. Alternatively, for example, the holder handle 654 can be made with (i) a wire that is a different gauge than five, (ii) a discontinuous wire, (iii) a tube, or (iv) another type of structure. Non-exclusive examples of suitable materials for the holder handle 654 include aluminum or steel.

As provided above, FIG. 6E is a side view of the bag holder 650 with the holder handle 654 in the attachment position 680 securing the bag holder 650 to the door 686 that defines the vertical surface 676. Further, the FIG. 6F is a side view of the bag holder 650 with the bag holder 650 on the horizorital surface 672 with the bag handle 650 in the carrying position 678. With the designs provided herein, in certain embodiments, the bag holder 650 can be used to alternatively secure the t-shirt bag 651 to a door 686, holding at least a portion of the t-shirt bag 651 above the horizontal surface 672, or carrying the t-shirt bag 651.

In should be noted that in the embodiment illustrated in FIGS. 6A-6F, the holder handle 654 can slipped over and attached to the attachment beam 108 (illustrated in FIG. 1) instead being hung over the door 686. With this design, the bag holder 650 can be secured to the door 686 near the vertical surface 676 with the holder handle 654 not being visible from the other side of the door 686.

While the particular bag holder as shown and disclosed herein is fully capable of obtaining the objects and providing the advantages herein before stated, it is to be understood that it is merely illustrative of the presently preferred embodiments of the invention and that no limitations are intended to the details of construction or design herein shown other than as described in the appended claims.

What is claimed is:

1. A combination for use near a vertical surface, the combination comprising:

a t-shirt bag that includes a bag opening, a first bag handle and a second bag handle; and a bag holder including (i) a holder frame having a bag support region that supports the t-shirt type bag near the bag opening, a first handle restraint that selectively engages and retains the first bag handle, a second handle restraint that selectively engages and retains the second bag handle, and a backbone region that extends away from the bag support region; and (ii) a holder handle that is secured to the holder frame, the holder handle being movable relative to the holder frame between a carrying position in which the holder handle is used for carrying the holder frame, and an attachment position in which that holder handle is adapted to retain the holder frame near the vertical surface; wherein the holder handle pivots relative to the holder frame in a first rotational direction during movement of the holder handle from the attachment position to the carrying position, and wherein the holder handle includes an engagement region that engages the backbone region of the holder frame to inhibit rotation of the holder handle past the carrying position in the first rotational direction while simultaneously allowing the holder handle to freely rotate between the attachment position and the carrying position.

2. The combination of claim 1 wherein the holder frame includes a frame base region that is adapted to engage a horizontal surface to hold the bag support region, the handle restraints, and the bag opening above the horizontal surface; and wherein the backbone region connects the bag support region to the frame base region and maintains the bag support region spaced apart from the frame base region.

3. The combination of claim 2 wherein the handle restrains are each generally inverted "U"shaped and are positioned intermediate the bag support region and the frame base region.

4. The combination of claim 2 wherein the handle restrains extend upward from the frame base region towards the bag support region.

5. A combination for use near a vertical surface, the combination comprising:

a t-shirt bag that includes a bag opening, a first bag handle and a second bag handle; and a bag holder including (i) a holder frame having a bag support region that supports the t-shirt type bag near the bag opening, a first handle restraint that selectively engages and retains the first bag handle, and a second handle restraint that selectively engages and retains the second bag handle; and (ii) a holder handle that is secured to the holder frame, the holder handle being movable relative to the holder frame between a carrying position in which the holder handle is used for carrying the holder frame, and an attachment position in which that holder handle is adapted to retain the holder frame near the vertical surface; wherein the holder handle pivots relative to the holder frame in a first rotational direction during movement of the holder handle from the attachment position to the carrying position, and wherein the holder handle includes an engagement region that engages the holder frame to inhibit rotation of the holder handle past the carrying position in the first rotational direction while simultaneously allowing the holder handle to freely rotate between the attachment position and the carrying position;

wherein the holder frame includes a frame base region that is adapted to engage a horizontal surface to hold the bag support region, the handle restraints, and the bag opening above the horizontal surface; and wherein the holder frame includes a pair of spaced apart frame bumpers that extend away from the frame base region and that are adapted to engage the vertical surface to maintain the frame base region positioned away from the vertical surface, wherein each of the frame bumpers is a rigid beam that extends away from the frame base region.

6. The combination of claim 1 wherein the vertical surface is a door and the holder handle includes a generally U shaped handle hook region that engages a top of the door to attach the holder frame to the door.

7. A combination for use near a door, the combination comprising:

a t-shirt bag that includes a bag opening, a first bag handle and a second bag handle; and a bag holder including (i) a bag support region that supports the t-shirt type bag near the bag opening, a first handle restraint that selectively retains the first bag handle, and a second handle restraint that selectively retains the second bag handle; and (ii) a holder handle that is secured to the holder frame, the holder handle being movable relative to the holder frame between a carrying position in which the holder handle is used for carrying the holder frame, and an attachment position in which that holder handle retains the holder frame near the vertical surface, wherein the holder handle includes a body region that extends away from the holder frame and a generally U shaped handle hook region that extends away from the body region, wherein a first side of the U shaped handle hook is connected to the body region, and wherein a bottom of the U shaped handle hook and a second side of the U shaped handle hook cantilever away from the body region and engage the door to selectively attach the holder frame to the door; wherein the holder frame includes a frame base region that is adapted to engage a horizontal surface to hold the handle restraints, and the bag opening above the horizontal surface.

8. The combination of claim 7 wherein the handle restrains are each generally inverted "U"shaped and are positioned intermediate the bag support region and the frame base region.

9. The combination of claim 7 wherein the handle restrains extend upward from the frame base region towards the bag support region.

10. A combination for use near a door, the combination comprising:

a t-shirt bag that includes a bag opening, a first bag handle and a second bag handle; and a bag holder including (i) a bag support region that supports the t-shirt type bag near the bag opening, a first handle restraint that selectively retains the first bag handle, and a second handle restraint that selectively retains the second bag handle; (ii) a frame base region that is adapted to engage a horizontal surface to hold the handle restraints, and the bag opening above the horizontal surface; and (iii) a holder handle that is secured to the holder frame, the holder handle being movable relative to the holder frame between a carrying position in which the holder handle is used for carrying the holder frame, and an attachment position in which that holder handle retains the holder frame near the vertical surface, wherein the holder handle includes a generally U shaped handle hook region that engages a top of the door to selectively attach the holder frame to the door; wherein the holder frame includes a frame bumper that extends away from the frame base region and that is adapted to engage the vertical surface to maintain the frame base region positioned away from the vertical surface.

11. A combination for use near a door, the combination comprising:

a t-shirt bag that includes a bag opening, a first bag handle and a second bag handle; and a bag holder including (i) a bag support region that supports the t-shirt type bag near the bag opening, a first handle restraint that selectively retains the first bag handle, and a second handle restraint that selectively retains the second bag handle; and (ii) a holder handle that is secured to the holder frame, the holder handle being movable relative to the holder frame between a carrying position in which the holder handle is used for carrying the holder frame, and an attachment position in which that holder handle retains the holder frame near the vertical surface, wherein the holder handle includes a body region that extends away from the holder frame and a generally U shaped handle hook region that extends away from the body region, wherein a first side of the U shaped handle hook is connected to the body region, and wherein a bottom of the U shaped handle hook and a second side of the U shaped handle hook cantilever away from the body region and engage the door to selectively attach the holder frame to the door; wherein the holder handle pivots relative to the holder frame in a first rotational direction during movement of the holder handle from the attachment position to the carrying position, and wherein the holder handle includes an engagement region that engages the holder frame to inhibit rotation of the holder handle past the carrying position in the first rotational direction while simultaneously allowing the holder handle to freely move between the attachment position and the carrying position.

12. A combination for use near a vertical surface or a horizontal surface, the combination comprising:

a t-shirt bag that includes a bag opening, a first bag handle and a second bag handle; and a bag holder including (i) a holder frame having a bag support region that supports the t-shirt type bag near the bag opening, a first handle restraint that selectively engages and retains the first bag handle, a second handle restraint that selectively engages and retains the second bag handle, a frame base region that is adapted to engage the horizontal surface to hold the bag support region, the handle restraints, and the bag opening above the horizontal surface, and a backbone region the connects the bag support region to the frame base region and maintains the bag support region spaced apart from the frame base region; and (ii) a holder handle that is secured to the holder frame, the holder handle being movable relative to the holder frame between a carrying position in which the holder handle is used for carrying the holder frame, and an attachment position in which that holder handle is adapted to retain the holder frame near the vertical surface; wherein the holder handle pivots relative to the holder frame in a first rotational direction during movement of the holder handle from the attachment position to the carrying position, and wherein the holder handle includes an engagement region that engages the backbone region to inhibit rotation of the holder handle past the carrying position in the first rotational direction while simultaneously allowing the holder handle to freely rotate between the attachment position and the carrying position.

13. The combination of claim 12 wherein the holder handle includes a generally straight handle body region, and wherein the handle body region is substantially parallel to the bag support region in the carrying position and the handle carrying section is substantially perpendicular to the bag support region in the attachment position.

14. The combination of claim 13 wherein the holder handle includes a generally U shaped handle hook region that engages a top of a door to selectively attach the holder frame to the door.

15. The combination of claim 14 wherein the handle restrains extend upward from the frame base region towards the bag support region.

16. The combination of claim 12 wherein the holder frame includes a pair of spaced apart frame bumpers that extend away from the frame base region and that are adapted to engage the vertical surface to maintain the frame base region positioned away from the vertical surface, wherein each of the frame bumpers is a rigid beam.

17. The combination of claim 12 wherein the holder handle includes a looped region that encircles a portion of the bag support region to allow the holder handle to pivot relative to the holder frame.

18. The combination of claim 12 wherein the holder handle includes a pair of spaced apart looped regions that each encircles a portion of the bag support region to allow the holder handle to pivot relative to the holder frame, and a pair of spaced apart engagement regions that engage the backbone region.

19. The combination of claim 12 wherein the bag support region includes a beam that is formed into a somewhat oval configuration, wherein the backbone region includes a pair of spaced apart beams, wherein the frame base region includes a pair of spaced apart curved beams, and wherein each handle restrain is a beam that extends upward from the frame base region towards the bag support region.

20. A combination for use near a door, the combination comprising:

a t-shirt bag that includes a bag opening, a first bag handle and a second bag handle; and a bag holder including (i) a bag support region that supports the t-shirt type bag near the bag opening, a first handle restraint that selectively retains the first bag handle, and a second handle restraint that selectively retains the second bag handle; (ii) a frame base region that is adapted to engage a horizontal surface to hold the handle restraints, and the bag opening above the horizontal surface; (iii) a holder handle that is secured to the holder frame, the holder handle being movable relative to the holder frame between a carrying position in which the holder handle is used for carrying the holder frame, and an attachment position in which that holder handle retains the holder frame near the vertical surface, and (iv) a frame bumper that extends away from the frame base region and that is adapted to engage the vertical surface to maintain the frame base region positioned away from the vertical surface.

* * * * *